US007611327B2

(12) United States Patent
Holston et al.

(10) Patent No.: US 7,611,327 B2
(45) Date of Patent: Nov. 3, 2009

(54) FAN MOUNTING SYSTEM

(75) Inventors: Ashby E. Holston, Kokomo, IN (US); Donald J. Greer, Kempton, IN (US); Ray E. Bradway, Jr., Kokomo, IN (US); Craig L. Carlson, Noblesville, IN (US); Lee A. Ols, Greentown, IN (US); Thurman R. Reed, McAllen, TX (US); Michael P. Kewley, Kokomo, IN (US); Roger E. Robins, Kokomo, IN (US); Edward C. Bernard, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 509 days.

(21) Appl. No.: 11/167,790

(22) Filed: Jun. 27, 2005

(65) Prior Publication Data

US 2006/0292010 A1 Dec. 28, 2006

(51) Int. Cl.
*F03D 11/04* (2006.01)
*F04D 29/60* (2006.01)

(52) U.S. Cl. ..... 415/213.1; 416/244 R; 415/220

(58) Field of Classification Search ..... 415/213.1, 415/220; 403/9, 375, 349, 348, 353, 350; 416/244 R; 411/104, 522
See application file for complete search history.

(56) References Cited

U.S. PATENT DOCUMENTS

| | | | | | |
|---|---|---|---|---|---|
| 4,787,602 | A * | 11/1988 | Pidgeon | ..... | 256/23 |
| 5,498,130 | A * | 3/1996 | Wakley et al. | ..... | 415/213.1 |
| 5,788,566 | A * | 8/1998 | McAnally et al. | ..... | 454/184 |
| 5,906,475 | A * | 5/1999 | Melane et al. | ..... | 415/214.1 |
| 7,040,862 | B2 * | 5/2006 | Otsuka | ..... | 415/214.1 |

* cited by examiner

*Primary Examiner*—Edward Look
*Assistant Examiner*—Sean J Younger
(74) *Attorney, Agent, or Firm*—Jimmy L. Funke

(57) ABSTRACT

A mounting system for mounting a rotary member to a stationary member. The mounting system includes a carrier adapted to engage the rotary member, wherein the carrier includes a mounting leg portion which terminates into a pair of resilient leg portions. The carrier may also further include a spring member adapted to engage a first surface of the stationary member. At least one of the legs in the pair of resilient leg portions includes a turned-out portion adapted to engage a second surface of said stationary member.

4 Claims, 9 Drawing Sheets

FAN MOUNTING SYSTEM

BACKGROUND

When electronic components operate, they produce heat. In some, low power, applications, this heat can be adequately removed using free convection cooling. However, in many applications, free convection cooling (the un-aided movement of air) does not provide sufficient cooling to prevent overheating (and possibly premature failure) of electronic components. In applications where free convection cooling does not offer sufficient cooling capacity, electric fans are often used as a low cost way of moving ambient air across the electronic components at a higher rate than that possible using free convection cooling. Accordingly, the use of cooling fans is often employed as a low cost solution for keeping electronic components operating within the acceptable temperature ranges specified by the electronic component manufacturers.

Cooling fans are often integrated with an enclosure which houses, amongst other components, the electronic components to be cooled by the fan. The cooling fan is often mounted to the enclosure using fasteners such as screws, dowel pins, rivets, or the like. Although this fastening technique is widely used, it significantly increases the cost of the product due to the labor and tools that are needed to install the fasteners and the handling costs associated with handling the fasteners.

Embodiments set forth herein disclose a system for eliminating fasteners traditionally used for securing cooling fans to an enclosure. The embodiments disclosed herein can be utilized in various applications including the automotive, computer, electronic instrumentation, or in any industry where the forced movement of air is used as a temperature controlling medium.

DETAILED DESCRIPTION

Figure 1:
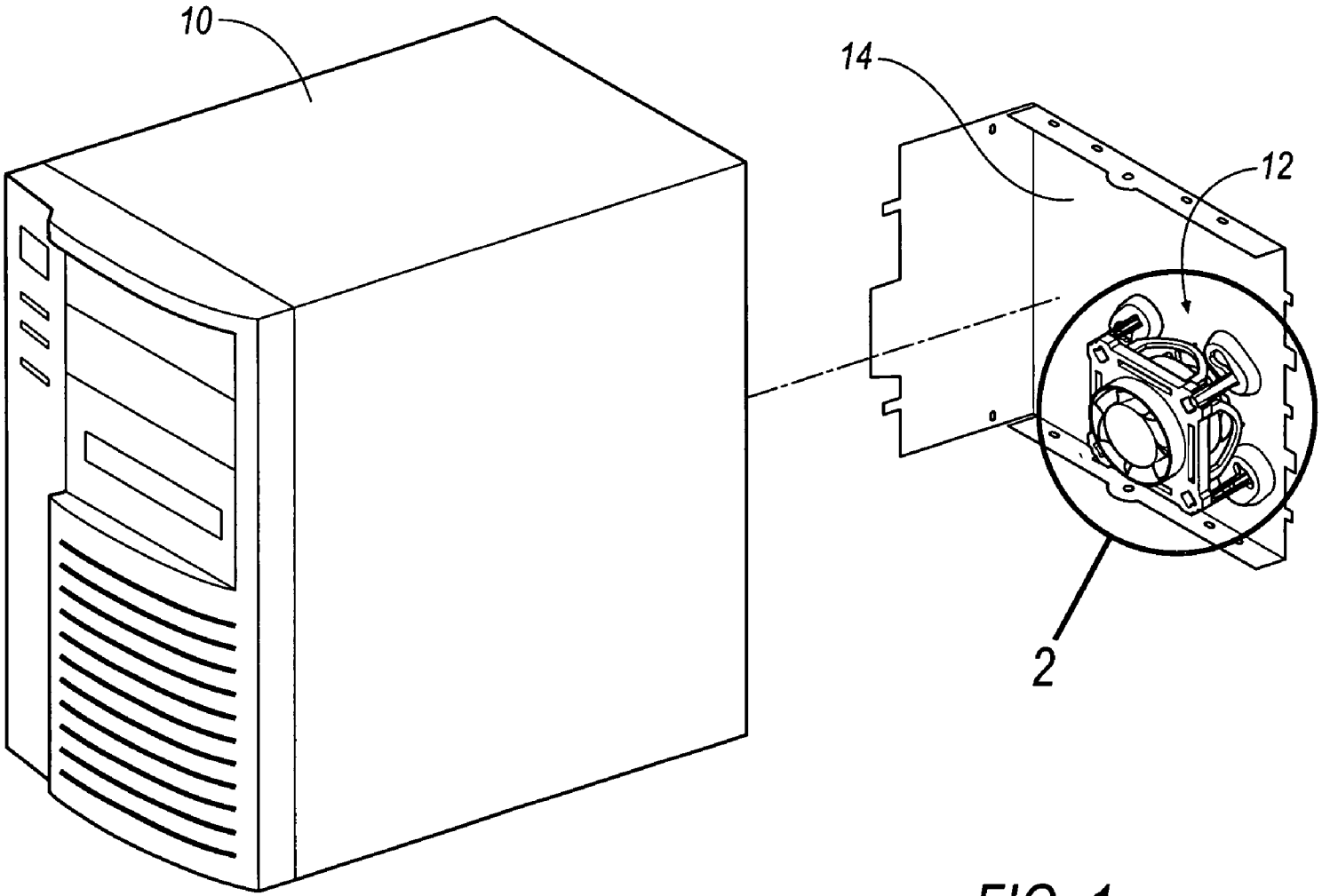
FIG. 1 is an isometric view of an embodiment of the cooling fan mounting system of the present invention used in conjunction with a computer tower.

Now referring to FIG. 1, an embodiment of the cooling fan assembly 12 of the present invention is shown in use with a panel 14 of computer tower 10. Although cooling fan assembly 12 can be used in any computer application where forced air cooling is necessary, it is not limited to those applications and one skilled in the art will readily recognize that the cooling fan assembly of the present invention is applicable in any application where forced air movement is relied upon for adequate cooling of any heat generating system (electrical, mechanical, chemical, or the like).

Figure 2:
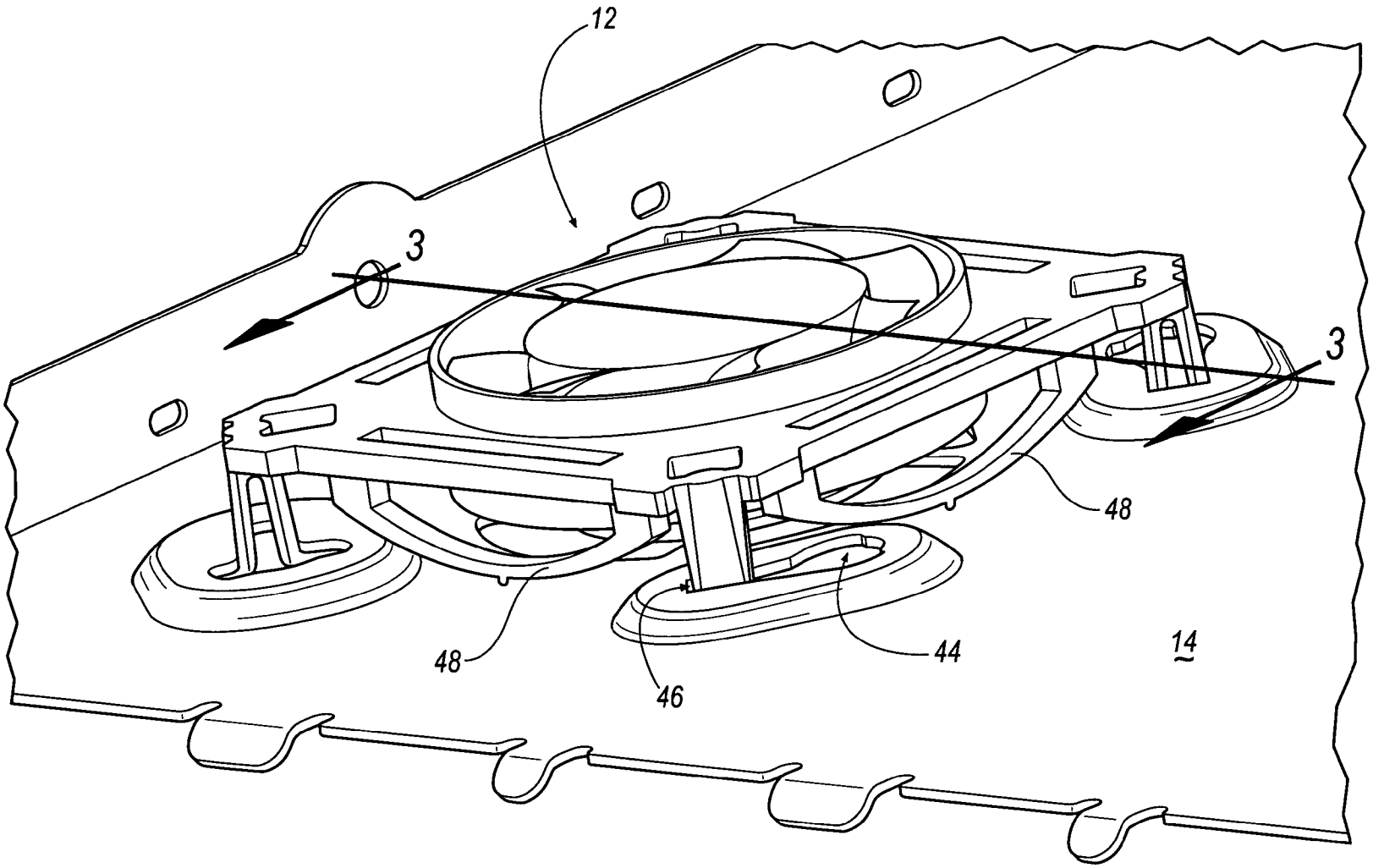
FIG. 2 is an exploded enlarged isometric view of encircled portion 2 of FIG. 1 from a different perspective.
Figure 3:
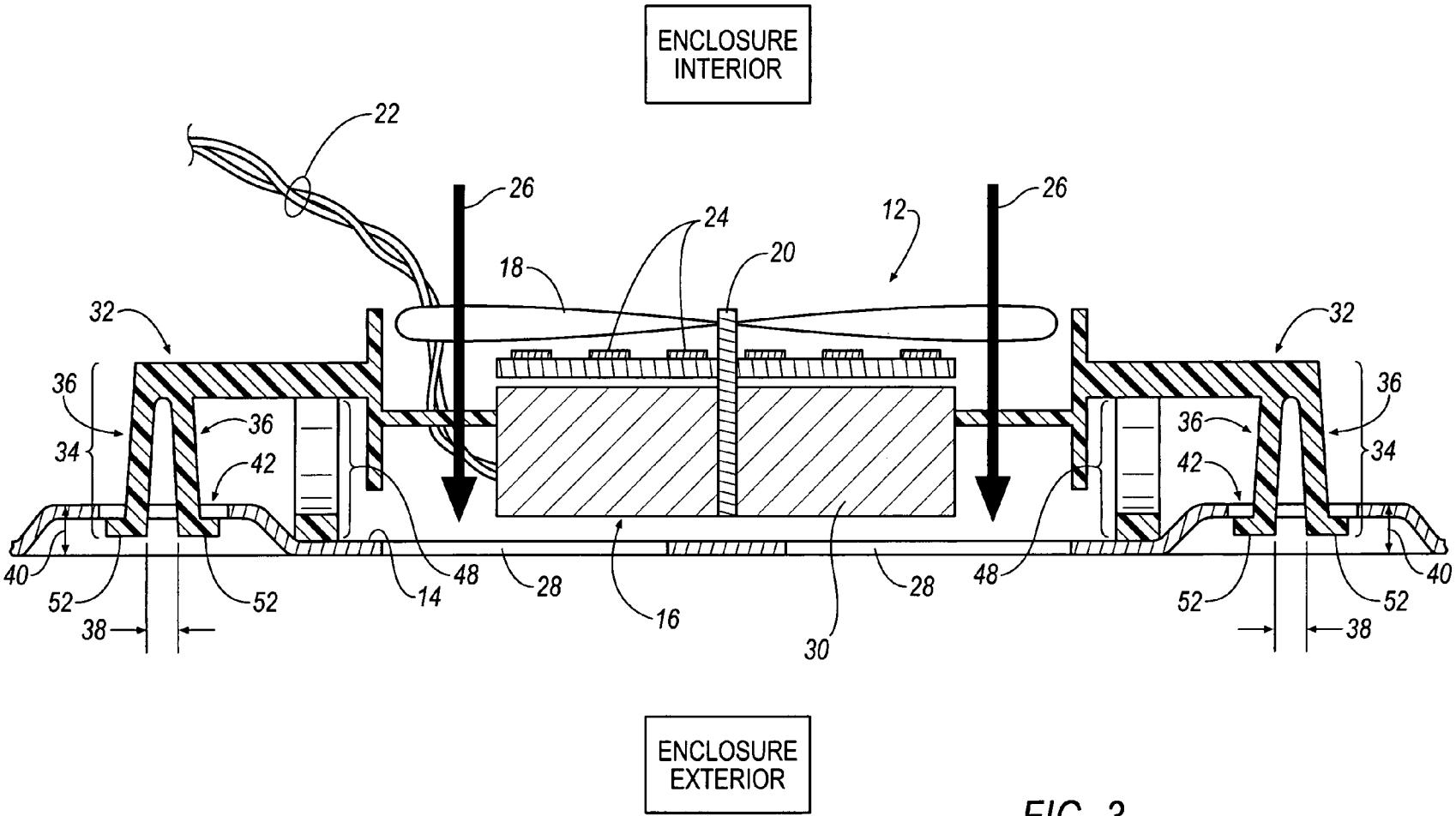
FIG. 3 is a partial cross-sectional view taken substantially through lines 3-3 of FIG. 2.

Now referring to FIG. 2 and FIG. 3, panel 14 can comprise any stationary member to which cooling fan assembly 12 is to be mounted. However, typically cooling fans are mounted to sheet-like stationary members (typically sheet metal panels). Throughout this disclosure, the device to which assembly 12 is mounted will be primarily referred to as a panel or stationary member; however, structures other than panels are fully contemplated within the scope of this disclosure. Panel 14 provides the mounting interface for supporting cooling fan assembly 12. Cooling fan assembly 12 includes a motor 16 which is used to rotate a fan blade 18 by way of a motor output shaft 20. In one embodiment of the present invention, motor 16 is an electrical motor which receives its electrical power requirements via power conductors 22. Although in many applications, the preferred embodiment of motor 16 is an electric motor, it is well within the scope of this invention to use non-electric motors as the primary mover for moving fan blade 18. Other primary movers that might be appropriate in various applications, include hydraulic motors, pneumatic motors, and the like. In some embodiments, depending on the type of electric motor that may be used, it may be convenient or cost effective to mount electronic motor control components 24 on, or about, motor 16. In other applications, it may not be appropriate to mount motor control components on, or about, motor 16 and in such cases, motor control components 24 can be mounted separate from motor 16.

In the majority of applications, it is most appropriate to establish the rotation of fan blade 18 such that it moves warm air, designated by arrows 26, from the interior of an enclosure to the exterior of the enclosure through enclosure exhaust portals 28. The enclosure is typically fitted with enclosure intake portals (intake portals not shown) which allow ambient air to enter into the enclosure interior to replace the air exhausted by cooling fan assembly 12.

In one embodiment the motor 16 includes non-rotatable housing 30 which houses the operative components of motor 16. The housing 30 is coupled to a motor carrier 32. In one embodiment of the present invention, motor housing 30 is integrally formed (such as using plastic injection molding techniques) with motor carrier 32 to form an integrated unit.

Motor carrier 32 includes a plurality of mounting legs 34. In one embodiment, each mounting leg 34 terminates into a pair of resilient leg portions 36 which are separated by a compression gap 38. Each leg portion 36 may terminate into a turned-out portion 52. Panel 14 may include a plurality of recess portions 40 which are convex with respect to the enclosure interior (i.e. are depressed into the enclosure interior and away from the enclosure exterior). In one embodiment, there is a recess portion 40 to correspond with each of the plurality of mounting legs 34. Recess portion 40 includes an opening 42 which is shaped to include an enlarged opening region 44 and a residual opening region 46 (see FIG. 2). In one embodiment, the motor carrier 32 also includes a plurality of spring members 48. Spring members 48 are designed to urge motor carrier 32 away from panel 14 once the plurality of mounting legs 34 are in their fully seated position. This urging function provided by spring members 48 prevents motor carrier 32 from moving (due to the vibrational forces imparted to it during normal operation of motor 16) and becoming disengaged from its seated position. This feature will be discussed more fully in conjunction with FIGS. 4A-4I.

In one embodiment, the height of turned-out portions 52 is less than or equal to the height of recessed portion 40. By sizing turned-out portions 52 and recessed portions in this way, turned out portions 52 will not extend beyond the plane defined by the enclosure exterior thereby allowing one or more adjacent components (not shown) to directly abut the exterior of the enclosure.

Now referring to FIGS. 4A-4F, the steps for installing the cooling fan assembly 12 of the present invention are depicted.

Figure 4B:
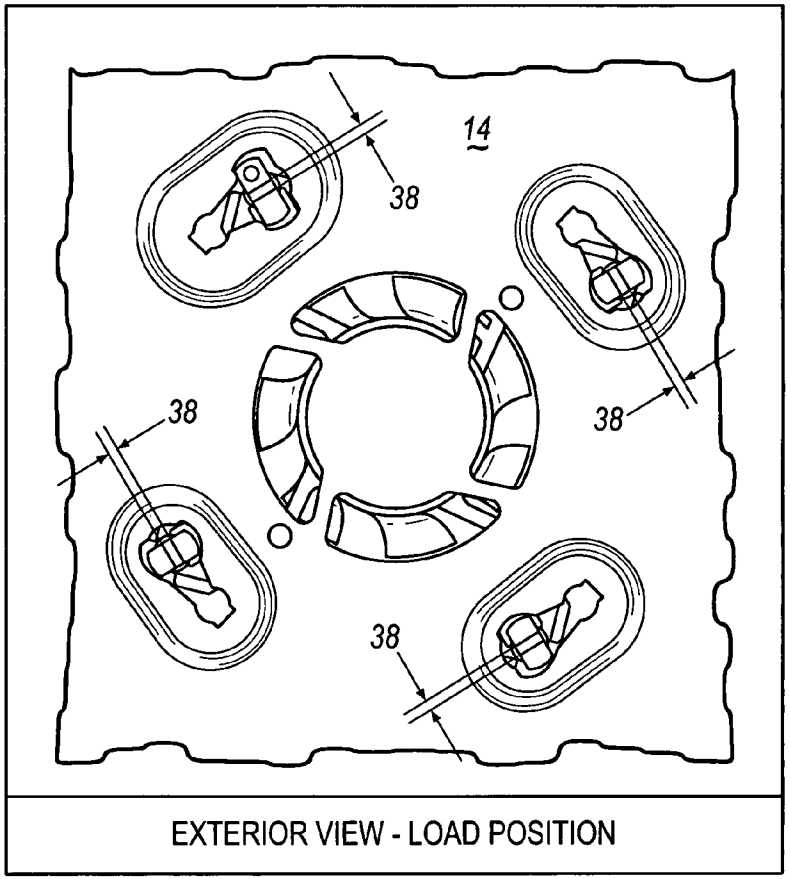
FIGS. 4A-4I are a series of grouped interior, exterior, and side views of the position of the fan enclosure (with respect to the panel on which it is mounted) at various stages of fan assembly installation.
Figure 4A:
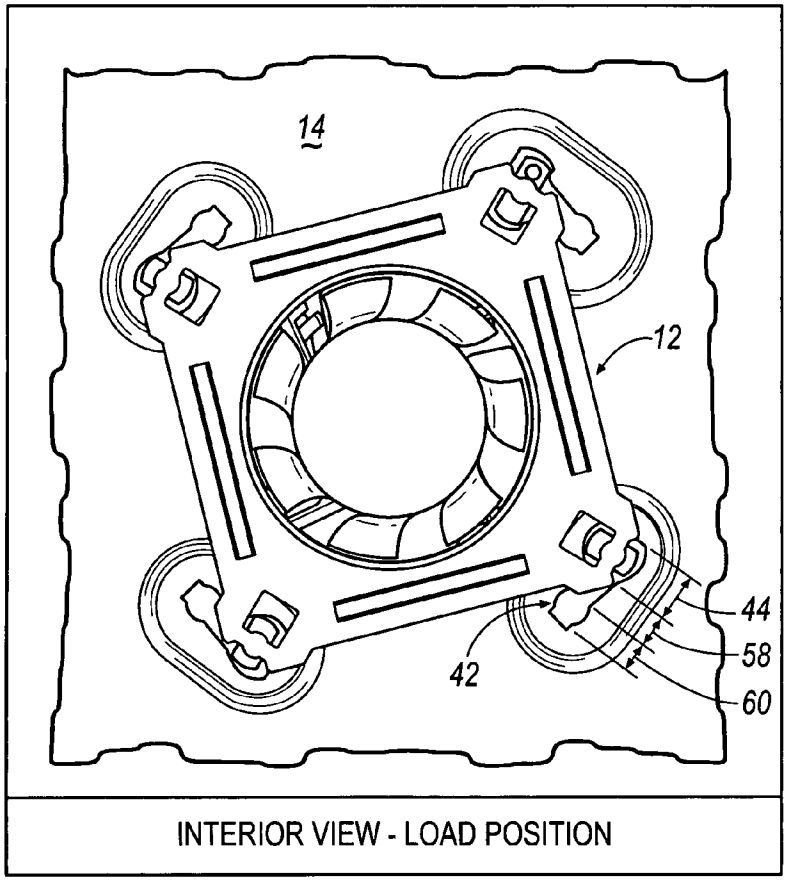
Figure 4C:
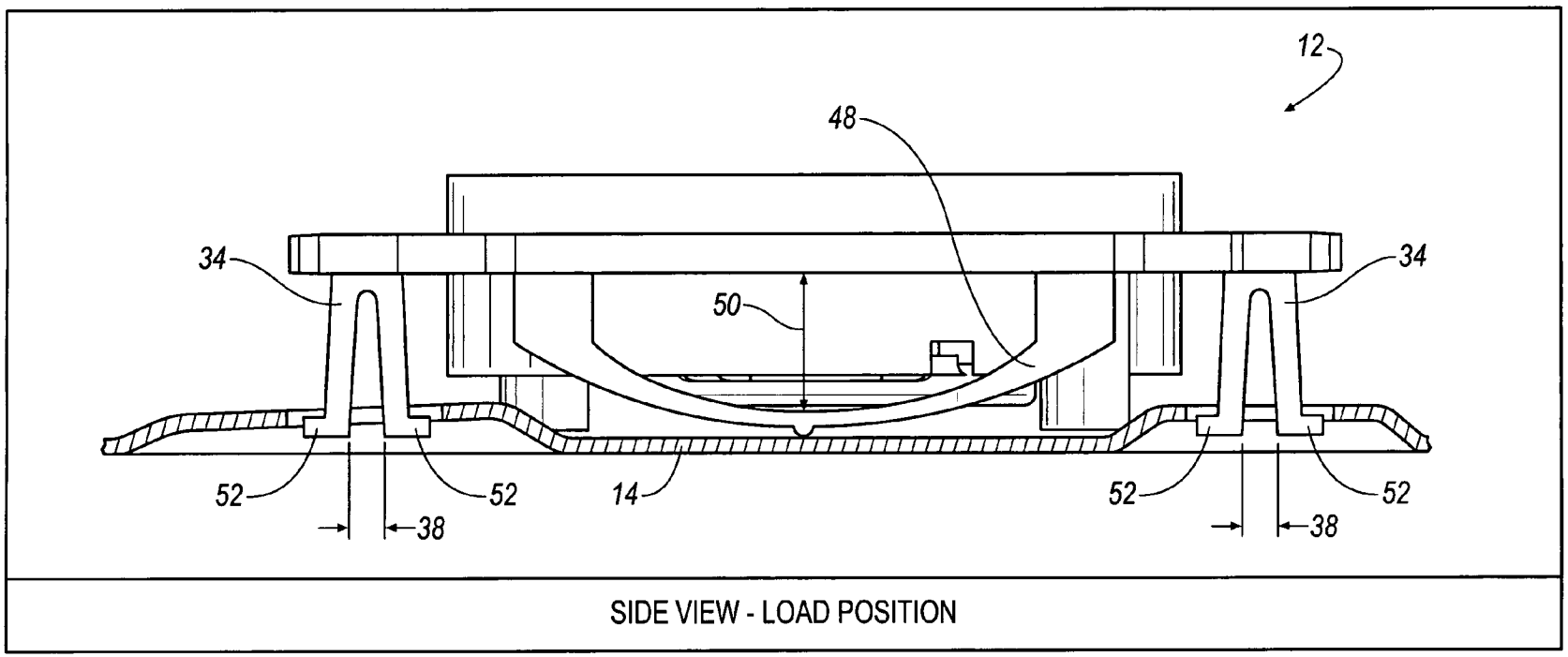

The initial positioning of the cooling fan assembly 12 against panel 14 is shown in FIGS. 4A-4C and is hereinafter referred to as the load position.

In the load position, cooling fan assembly 12 is brought adjacent panel 14 such that the turned-out portions 52 of each mounting leg 34 are inserted into a respectively associated enlarged opening region 44 of opening 42. Each turned-out portion 52 of the resilient legs 36 is sized in relation to its associated enlarged opening 44 such that the turned-out portions 52 freely pass into enlarged opening 44 without restriction. An interior view of the load position is shown in FIG. 4A and an exterior view (e.g. the view as seen from the exterior of enclosure 10) is shown in FIG. 4B. FIG. 4C shows a side view of the load position. It is important to note that in the load position, before any exertion force (designated by arrow 54) is applied to cooling fan assembly 12, cooling fan assembly 12 rests against a surface of panel 14 by virtue of the contact between the bottom most bowed portion of spring member 48 and the panel 14 (see FIG. 4C). It is also important to note that before any exertion force is applied against cooling fan assembly 12 toward panel 14, the turned-out end portions 52 of each resilient leg 36 do not pass completely through enlarged opening 44 of opening 42. In the load position, because enlarged opening 44 is sized larger than the turned-out portions 52 of resilient legs 36, no compression forces are exerted against pairs of resilient leg portions 36 and the compression gap 38 is at its maximum size.

Figure 4E:
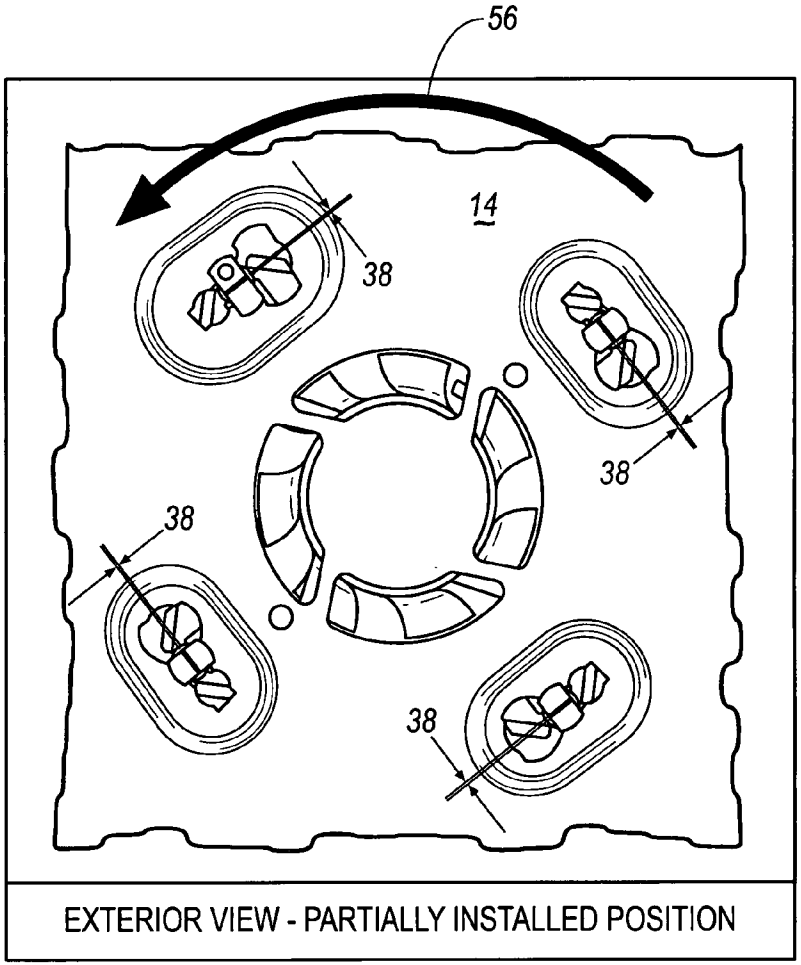
Figure 4D:
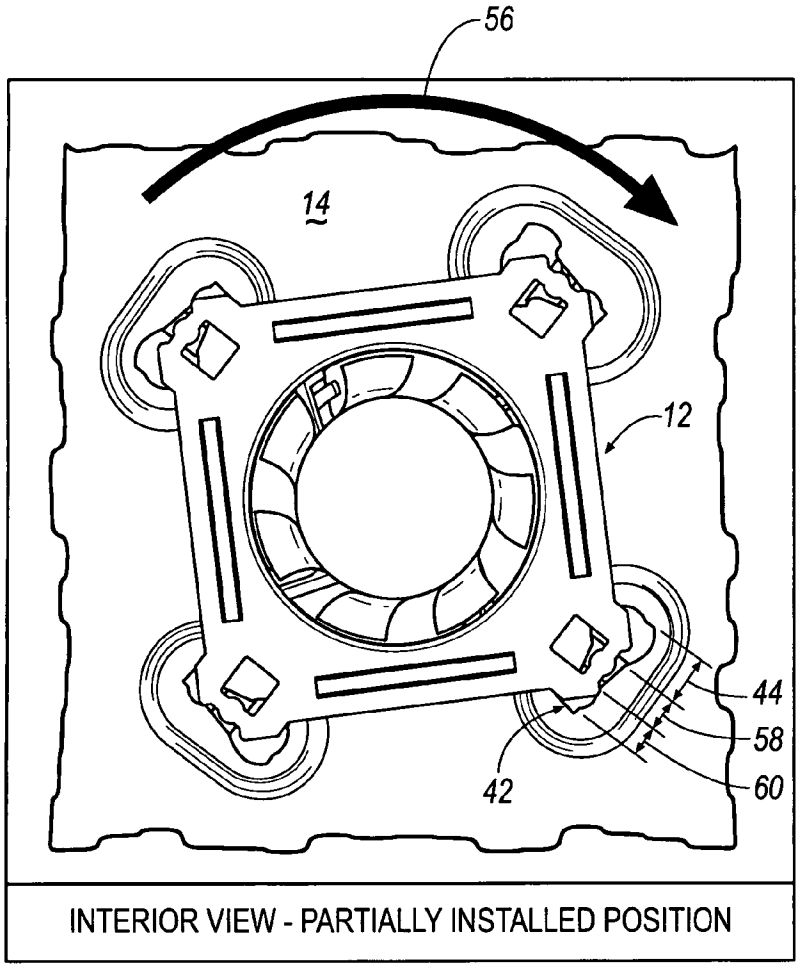
Figure 4F:
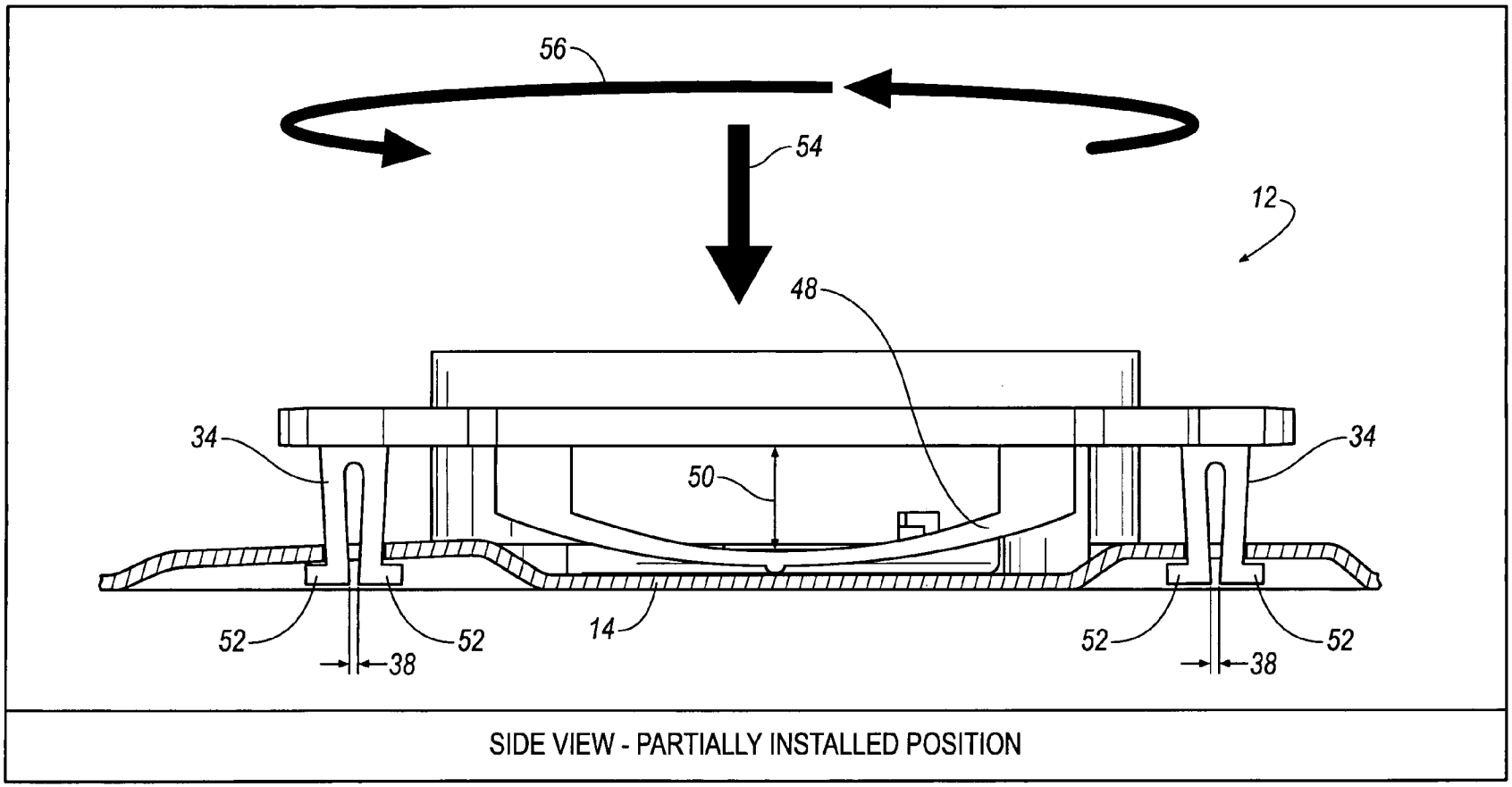

Now referring to FIGS. 4D-4F, in order to move the cooling fan assembly 12 from the load position (FIGS. 4A-4C) into the partially installed position (FIGS. 4D-4F), a combined compressive 54 and a rotating 56 force (arrows) must be imparted to at least one of the cooling fan assembly 12 or the panel 14. The compressive force 54 acts to compress spring member 48 and move turned-out portions 52 fully into recess 40, while the rotating force 56 repositions resilient legs 36 into an intermediate sized opening 58 of opening 42. By comparing the length of dimension 50 between FIG. 4C and FIG. 4F, it is easily seen that dimension 50 in FIG. 4F is much smaller than it is in FIG. 4C. This is a depiction of the compression of spring 48. Intermediate opening 58 is smaller than enlarged opening 44 which acts to bring together each pair of resilient leg portions 36 when rotating force 56 is exerted. Intermediate opening 58 is sized sufficiently small such that the turned-out portions 52 of each resilient leg 36 cannot pull through intermediate opening 58 under the urging of compressed spring member 48.

Figure 4H:
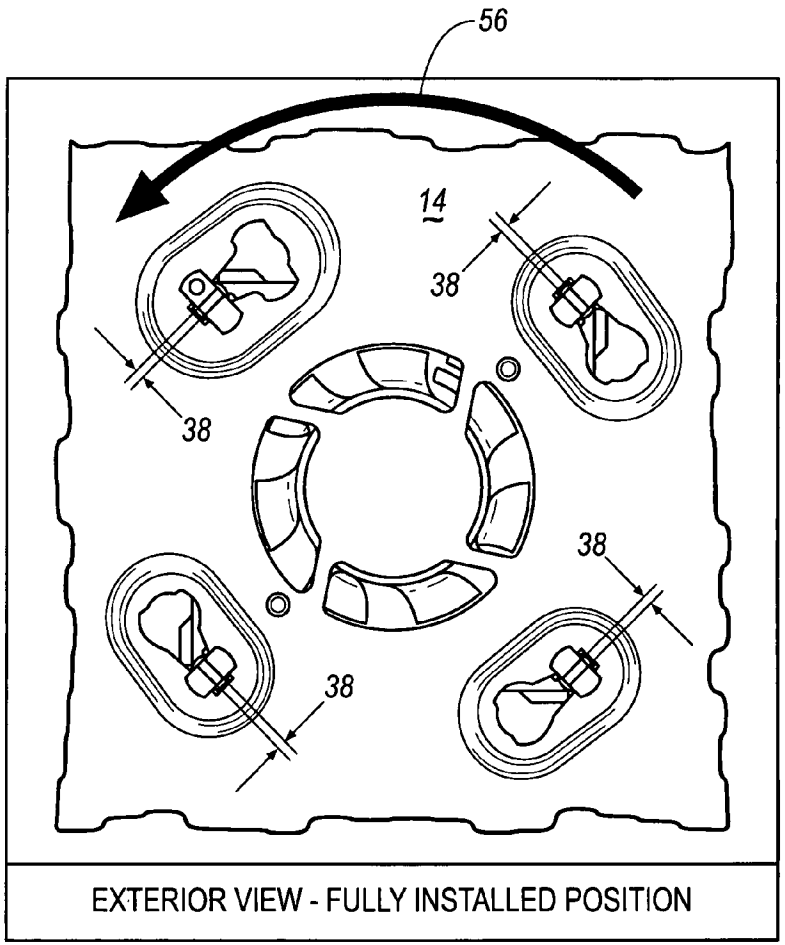
Figure 4G:
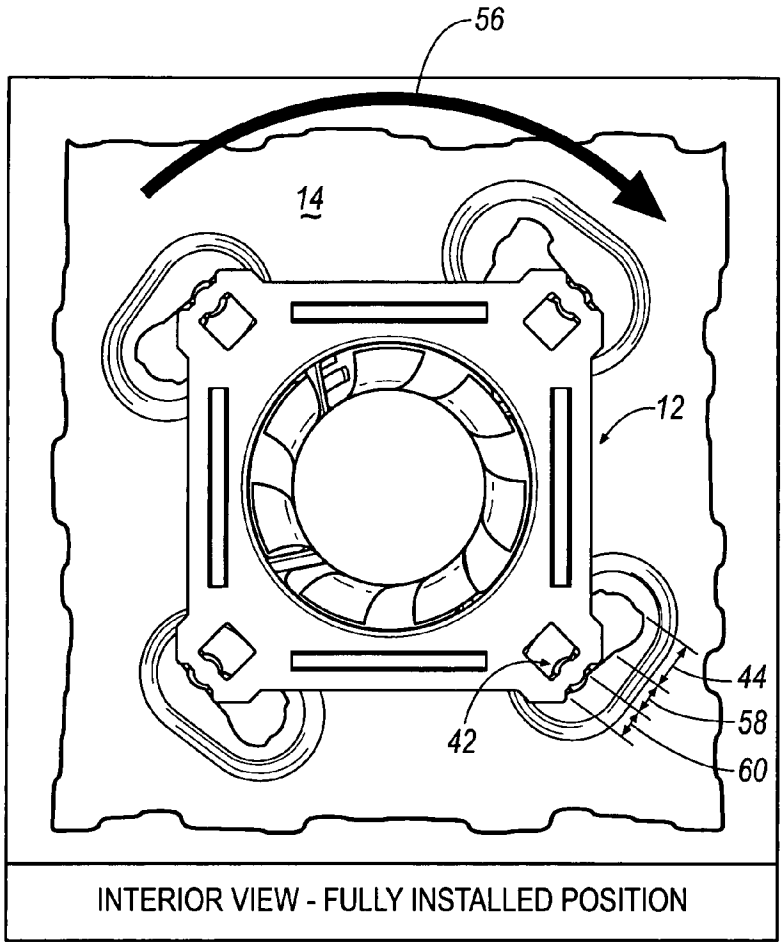
Figure 4I:
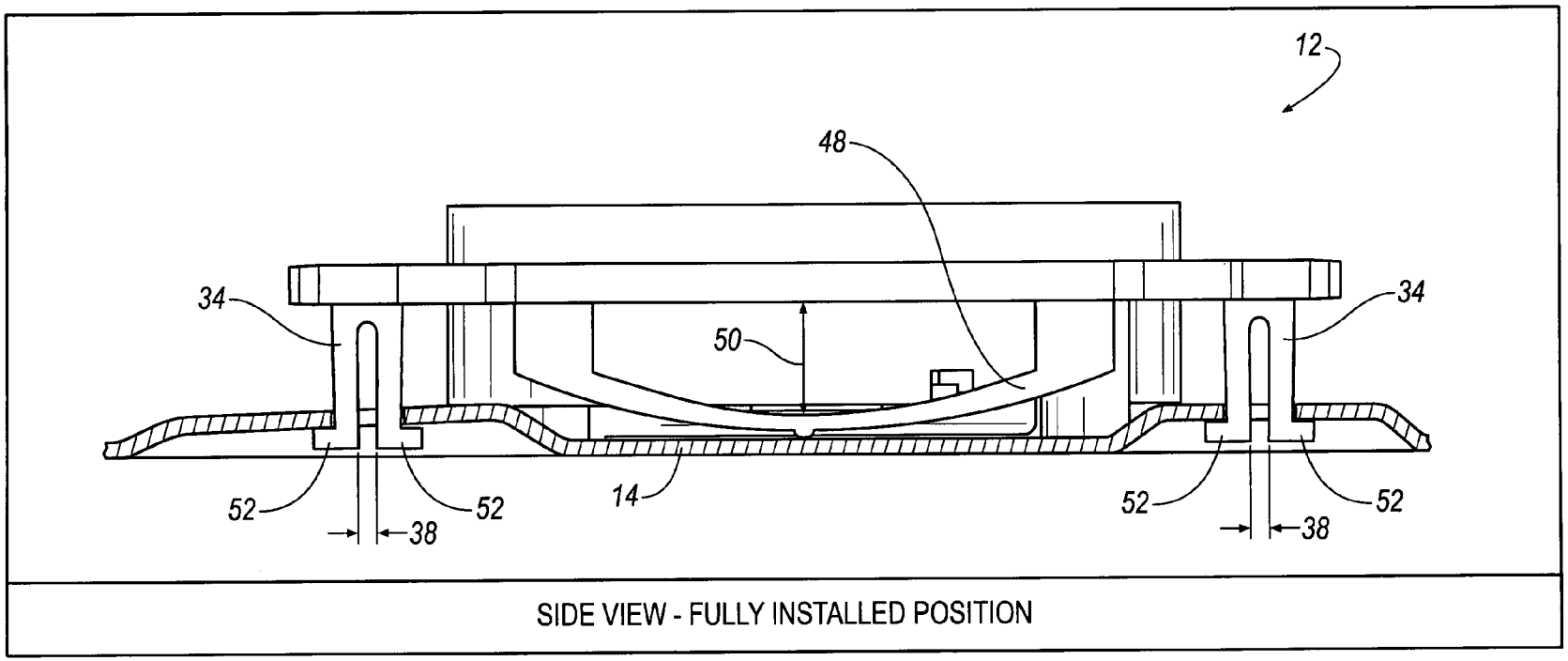

Now referring to FIGS. 4G-4I, as cooling fan assembly 12 is further rotated 56 from the partially installed position (as shown in FIGS. 4D-4F) into the fully installed position (shown in FIGS. 4G-4I), resilient leg portions 36 of each mounting leg 34 enter into a third portion of opening 42 called the residual opening 60. Residual opening 60 is sized smaller than enlarged opening 44 but not as small as intermediate opening 58. Thus, when each pair of resilient leg portions 36 transition from the intermediate opening 58 into residual opening 60, they spring outwardly. This outward movement captures each leg portion pair 36 within its respectively associated residual opening 60. The relative compression experienced by each pair of resilient leg portions 36 at each stage of installation can be seen by comparing the size of the compression gap 38 as the installation progresses from the load position (FIG. 4B) through the partially installed position (FIG. 4E) and, finally into the fully installed position (FIG. 4H). In the fully installed position, spring member 48 remains in a compressed state thereby urging turned-out portions 52 of resilient leg portions against the exterior surface of panel 14. This urging function performed by the spring member 48 assists in preventing vibrational noise from developing between the motor carrier 32 and the panel 14 and also serves to prevent vibrational forces from causing resilient leg portions 36 from "backing out" of their respectively associated residual opening 60.

Having described various embodiments of the present invention, it will be understood that various modifications or additions may be made to the preferred embodiments chosen here to illustrate the present invention without departing from the spirit of the present invention. For example, the embodiment of spring member 48 shown in the drawings is generally depicted as a compressible "bowed" member; however, any device which is capable of exerting an urging force between cooling fan assembly and panel 14 is within the contemplation of this disclosure. Accordingly, it is to be understood that the subject matter sought to be afforded protection hereby shall be deemed to extend to the subject matter defined in the appended claims (including all fair equivalents thereof).

What is claimed as new and desired to be protected by Letters Patent of the United States is:

1. A system for mounting a cooling fan to a stationery panel, said system comprising:

a stationary panel formed of generally planer sheet material defining parallel inner and outer surfaces;

an electric motor including a relatively fixed stator assembly and a rotating armature assembly;

a fan carried for rotation with said armature assembly; and a one-piece carrier mounting said electric motor and fan to said stationary panel adjacent an exhaust portal formed in said stationary panel, said carrier comprising, a body portion adapted for supporting said cooling fan assembly, a plurality of mounting legs integrally formed with said body portion and circumferentially arranged about an outer peripheral portion thereof, wherein each said mounting leg is bifurcated to form an outwardly depending diverging pair of cooperating spaced apart resilient leg portions terminating in opposed turned-out end portions configured to extend through a registering associated opening in said panel for inter-locking engagement therewith, and a plurality of spring members integrally formed with said body portion and circumferentially arranged between adjacent pairs of said mounting legs, wherein each said spring member extends from said body portion toward the stationary panel and is configured to continuously urge said body portion away from said stationary panel, wherein each said associated panel opening is elongated to define an enlarged opening region dimensioned to enable through passage of said associated mounting leg end portions when in a relaxed, spaced apart orientation, a residual opening region dimensioned smaller than said enlarged opening region to receive associated leg portions only when compressed partially toward one another, and an intermediate opening region dimensioned smaller than both said enlarged opening region and residual opening region to permit through passage of said associated mounting leg portions only when compressed substantially completely toward one another, wherein each said associated panel opening is circumferentially elongated to enable inter-locking engagement of said mounting legs therein by limited relative rotational displacement of said body portion with respect to said stationary panel.

2. The system of claim 1, wherein said panel member defines a recess registering with each said associated opening, wherein each said recess extends in the direction of the stationary panel inner surface toward said fan and motor, and wherein the associated leg turned-out portions reside in the recess.

3. The system of claim 2, wherein the associated leg turned-out portions have a characteristic thickness dimensioned less than or equal to a height of the recessed portion.

4. A system for mounting a cooling fan to a stationery panel, said system comprising:

a stationary panel formed of generally planer sheet material defining parallel inner and outer surfaces;

an electric motor including a relatively fixed stator assembly and a rotating armature assembly;

a fan carried for rotation with said armature assembly; and a one-piece carrier mounting said electric motor and fan to said stationary panel adjacent an exhaust portal formed in said stationary panel, said carrier comprising, a body portion adapted for supporting said cooling fan assembly, a plurality of mounting legs integrally formed with said body portion and circumferentially arranged about an outer peripheral portion thereof, wherein each said mounting leg is bifurcated to form an outwardly depending diverging pair of cooperating spaced apart resilient leg portions terminating in opposed turned-out end portions configured to extend through a registering associated opening in said panel for inter-locking engagement therewith, and a plurality of spring members integrally formed with said body portion and circumferentially arranged between adjacent pairs of said mounting legs, wherein each said spring member extends from said body portion toward the stationary panel and is configured to continuously urge said body portion away from said stationary panel, wherein each said associated panel opening is elongated to define an enlarged opening region dimensioned to enable through passage of said associated mounting leg end portions when in a relaxed, spaced apart orientation, a residual opening region dimensioned smaller than said enlarged opening region to receive associated leg portions only when compressed partially toward one another, and an intermediate opening region dimensioned smaller than both said enlarged opening region and residual opening region to permit through passage of said associated mounting leg portions only when compressed substantially completely toward one another, wherein said panel member defines a recess registering with each said associated opening, wherein each said recess extends in the direction of the stationary panel inner surface toward said fan and motor, and wherein the associated leg turned-out portions reside in the recess, and wherein the associated leg turned-out portions have a characteristic thickness dimensioned less than or equal to a height of the recessed portion wherein each said associated panel opening is circumferentially elongated to enable inter-locking engagement of said mounting legs therein by limited relative rotational displacement of said body portion with respect to said stationary panel.

* * * * *